US005664958A

United States Patent [19]

Chadwick et al.

[11] Patent Number: 5,664,958

[45] Date of Patent: Sep. 9, 1997

[54] ELECTRICAL CONNECTOR FOR WORN ELECTRICAL OUTLETS

[75] Inventors: Dale Chadwick, Endwell; Mark Levy, Vestal; Gary Roden; John Schneider, both of Apalachin, all of N.Y.

[73] Assignee: Society of American Independent Inventors, Binghamton, N.Y.

[21] Appl. No.: 589,530

[22] Filed: Jan. 22, 1996

[51] Int. Cl.[6] ..... H01R 11/22

[52] U.S. Cl. ..... 439/269.2; 439/651

[58] Field of Search ..... 439/651, 160, 439/269.2

[56] References Cited

U.S. PATENT DOCUMENTS

| | | | |
|---|---|---|---|
| 1,119,864 | 12/1914 | Ovington et al. | 439/269.2 |
| 2,136,193 | 11/1938 | Karst | 439/269.2 |
| 2,245,986 | 6/1941 | Krauss | 439/269.2 |
| 2,443,797 | 6/1948 | Miller | 439/651 |
| 2,491,586 | 12/1949 | Schott | 439/651 |
| 2,775,744 | 12/1956 | Heuneman | 439/269.2 |
| 5,145,393 | 9/1992 | Schoon | 439/269.2 |

*Primary Examiner*—David L. Pirlot
*Assistant Examiner*—Tho D. Ta
*Attorney, Agent, or Firm*—Salzman & Levy

[57] ABSTRACT

The present invention features a removable electrical connector or adapter for securing the contact prongs of an electric plug to a worn outlet. The connector has a housing with at least two opposing, nonconducting side portions. Each side portion has a top and a bottom. Two contact prongs are spaced apart from each other and are movably mounted to at least one of the side portions. The contact prongs extend out of the top of the housing, which housing also has at least one aperture at the bottom. Electrical plug prongs can be inserted through this aperture to make an electrical connection with the set of contact prongs. In another embodiment, the electrical connector is a self-contained plug, permanently attached to its associated electrical appliance, and having movable prongs and a spring for biasing the prongs inwardly, against the contacts of an outlet, after insertion. In yet another embodiment of the invention, a spring is secured to outwardly-biased prongs, so that, upon squeezing the plug and inserting it into the outlet, the prongs are forced to separate and make contact with the inner contacts of the outlet.

12 Claims, 6 Drawing Sheets

ELECTRICAL CONNECTOR FOR WORN ELECTRICAL OUTLETS

FIELD OF THE INVENTION

The present invention pertains to electrical adapters and, more particularly, to adapters for making worn out electrical wall outlets or other electrical outlets operate efficiently again.

BACKGROUND OF THE INVENTION

Due to metal and component fatigue over many cycles of use, it is not unusual for electrical outlets to lose the mechanical holding and, thus, the electrical connection characteristics they once had. This results in plugs that may make only intermittent connections or that may fall out of their respective outlets altogether.

To date, the common means of regaining electrical contact between the plug of a common appliance (e.g., a toaster, a hair dryer, a vacuum cleaner, an electric shaver) and a worn out electrical wall outlet is to physically bend the prongs of the appliance plug outwardly until an electrical connection can be effected. This is occasionally unsafe and quite often ineffective, resulting in disconnection of the electrical power by one happenstance or another due to the looseness of the fit between the plug and the wall or other type of outlet.

U.S. Pat. No. 2,443,797, issued to W. J. MILLER on Jun. 22, 1948, discloses an electric plug adapter having a cam portion contact formed in the leg or contact prong of a standard electric plug. The cam portion is likely to make physical and electrical contact with an outlet that has been worn.

U.S. Pat. No. 2,491,586, issued to L. SCHOTT on Dec. 20, 1949, discloses an adapter for wall sockets. The adapter is a thin insulating body having resilient prongs and rearwardly folded extensions, which are placed in the wall outlet for providing a tighter connection through spring tension of the prongs. The adapter is not transportable with the electric plug of any particular appliance; it requires a substantially permanent installation at the outlet.

SUMMARY OF THE INVENTION

It is an object of the present invention to produce an electrical connector useful in effecting a positive electrical connection between a worn out electrical outlet and a plug.

It is also an object of the present invention to provide a removable adapter that can be disposed intermediate a plug and an outlet, for ensuring mechanical and electrical connection therebetween.

In accordance with the present invention, there is provided a removable electrical connector or adapter for securing the contact prongs of an electric plug to a worn outlet. The connector has a housing with at least two opposing, nonconducting side portions. Each side portion has a top and a bottom. Two contact prongs are spaced apart from each other and are movably mounted to at least one of the side portions. The contact prongs extend out of the top of the housing, which housing also has at least one aperture at the bottom. Electrical plug prongs can be inserted through this aperture to make an electrical connection with the set of contact prongs.

In another embodiment, the electrical connector is a self-contained plug, permanently attached to its associated electrical appliance, and having movable prongs and a spring for biasing the prongs inwardly, against the contacts of an outlet, after insertion.

In yet another embodiment of the invention, a spring is secured to outwardly-biased prongs, so that, upon squeezing the plug and inserting it into the outlet, the prongs are forced to separate and make contact with the inner contacts of the outlet.

BRIEF DESCRIPTION OF THE DRAWINGS

A complete understanding of the present invention may be obtained by reference to the accompanying drawings, when considered in conjunction with the subsequent detailed description, in which.

DESCRIPTION OF THE PREFERRED EMBODIMENTS

The present invention features a removable electrical connector or adapter for securing the contact prongs of an electric plug to a worn outlet. The connector has a housing with at least two opposing, nonconducting side portions. Each side portion has a top and a bottom. Two contact prongs are spaced apart from each other and are movably mounted to at least one of the side portions. The contact prongs extend out of the top of the housing, which housing also has at least one aperture at the bottom. Electrical plug prongs can be inserted through this aperture to make an electrical connection with the set of contact prongs. In another embodiment, the electrical connector is a self-contained plug.

Figure 1:
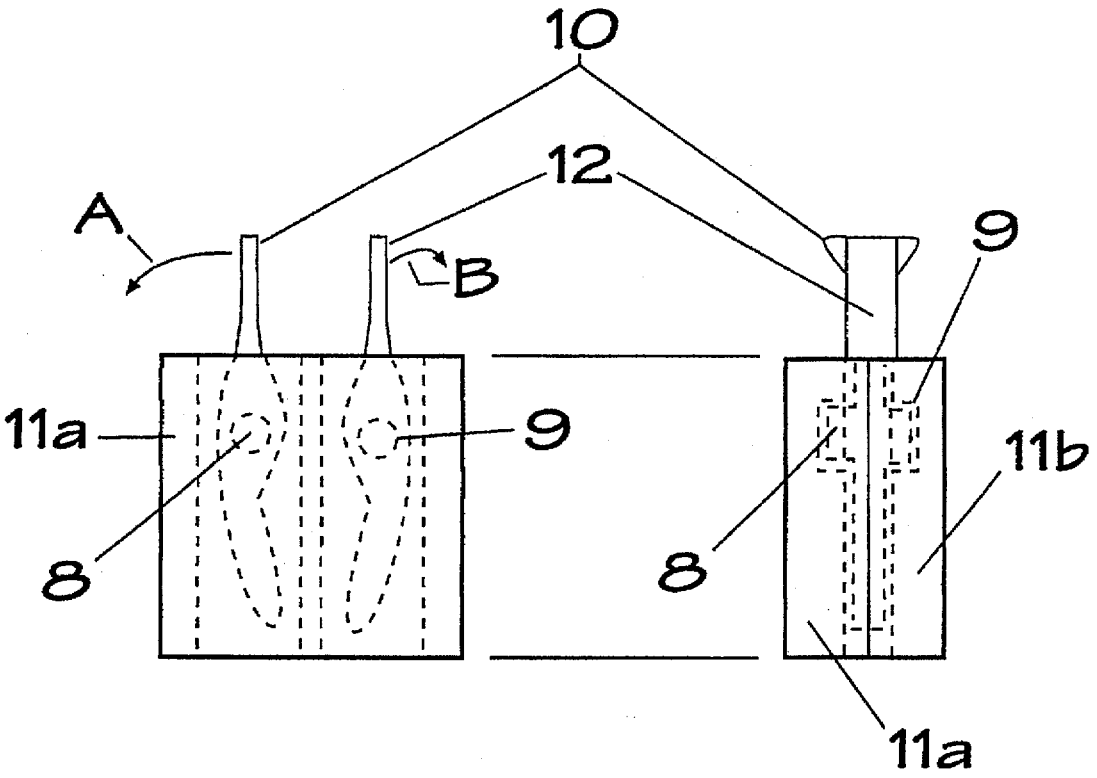
FIG. 1 depicts cross-sectional side views of the plug-to-outlet electrical connector in accordance with the invention.

Referring now to the drawings wherein like reference characters indicate like parts in the several views, there are shown in FIG. 1 several components of the inventive connector, assembled into the complete unit. A positive electrical contact prong 10 and a negative contact prong 12 are curved at their lower ends. When pushed into and against the outer surfaces of these two contact prongs 10 and 12, the curvature allows a conventional plug (not shown), to pivot its prongs about their respective integral pivot pins 8 and 9. Prong 10 will rotate counterclockwise (arrow A); prong 12 will rotate clockwise (arrow B). Prongs 10 and 12 which are insertable into an electrical wall outlet (not shown), move apart from one another and force themselves against the worn internal contacts of the outlet, making positive contact with the outlet's several electrical conductors. Nonconductive housing half 11*a*, when mated with corresponding nonconductive housing half 11*b*, forms a complete casing to house pivotable contact prongs 10 and 12.

Figure 2:
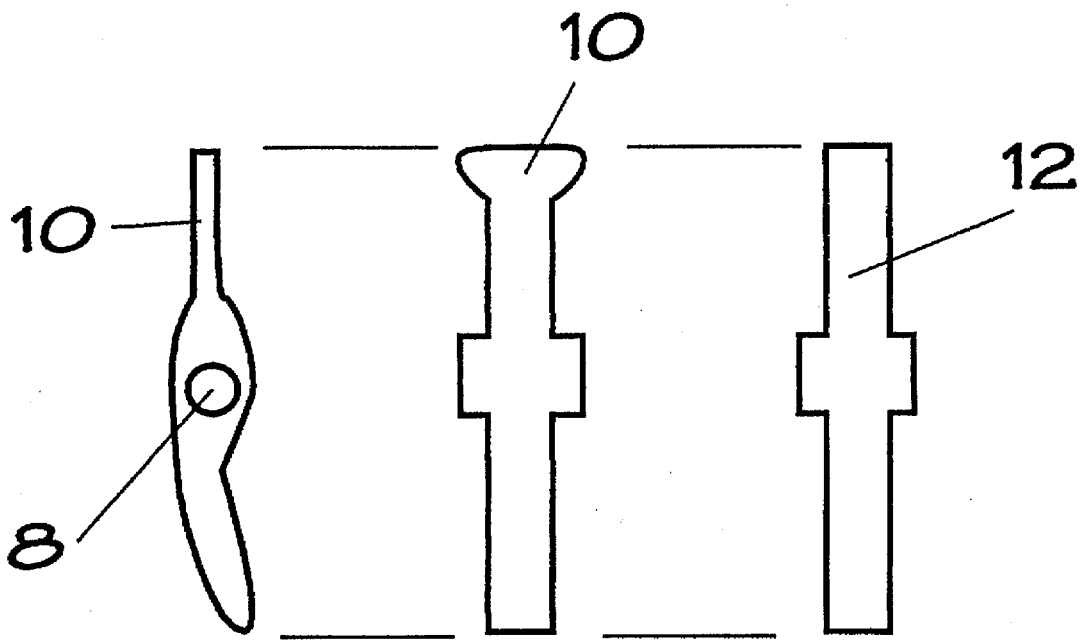
FIG. 2 is a view of the contact prongs of the device in FIG. 1.

Referring to FIG. 2, there is shown more detailed views of the contact prongs 10 and 12 and pivot pin 8.

Figure 3:
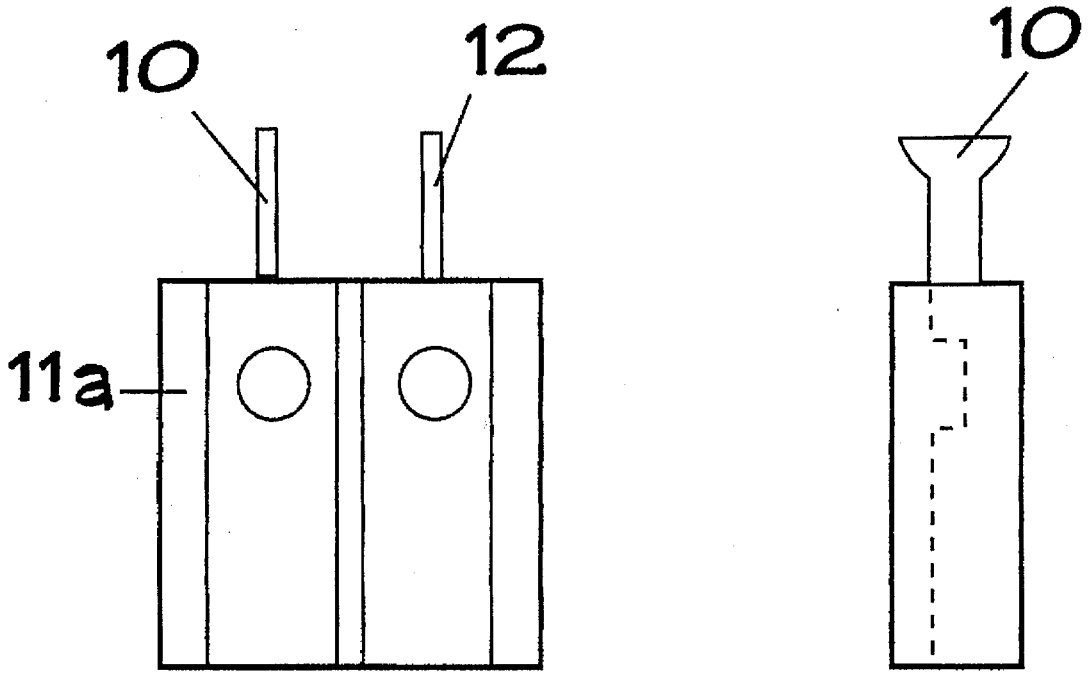
FIG. 3 is a view of the side portion of the device shown in FIG. 1.

FIG. 3 illustrates more detailed views of the housing half 11*a* and respective prongs 10 and 12.

Figure 4:
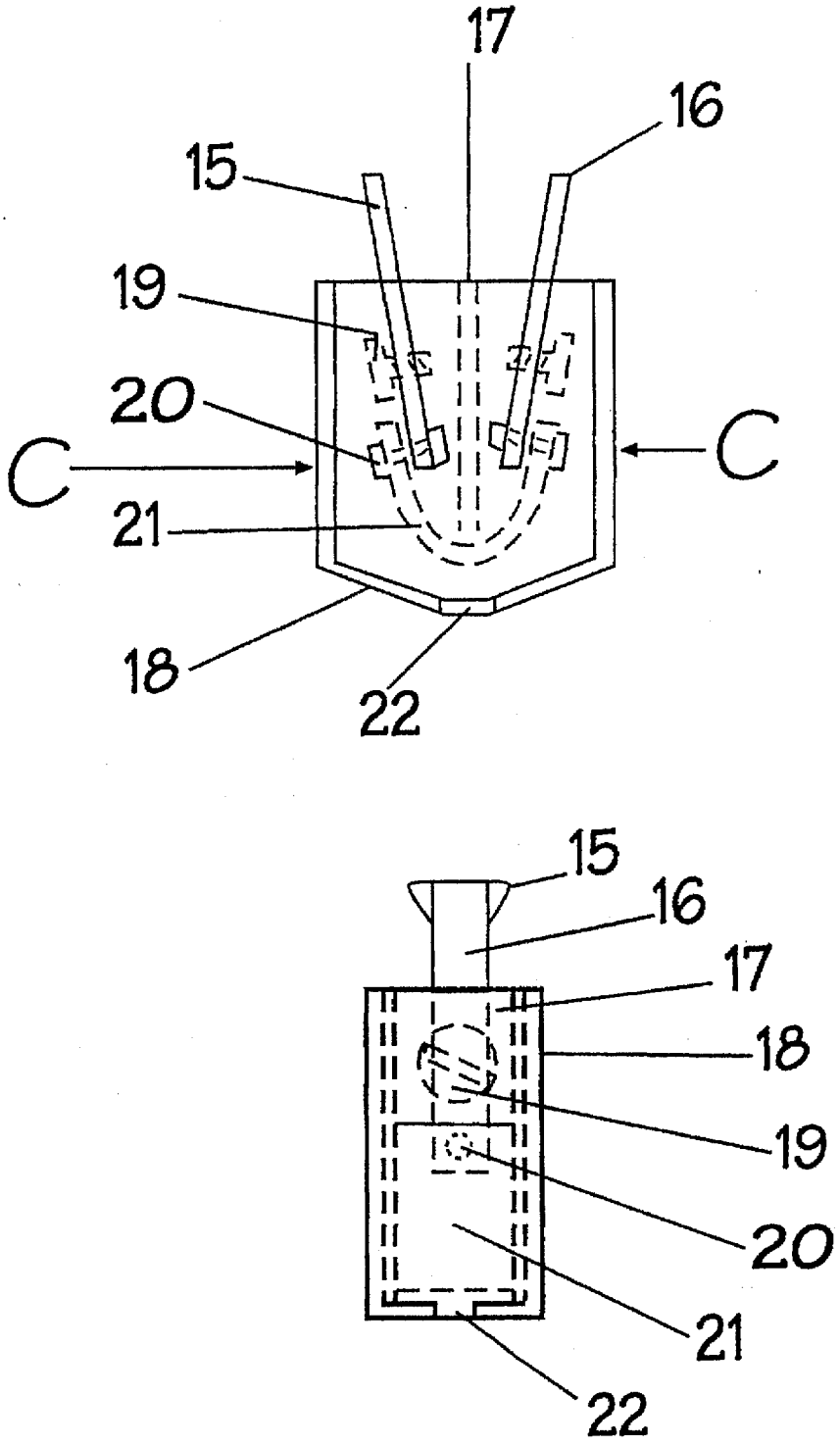
FIG. 4 depicts cross-sectional side views of an alternate embodiment of the invention, manually activated by squeezing.

Referring now also to FIG. 4, there is shown a detailed view of a device intended to accomplish the same purpose as the device shown in FIG. 1. This alternate embodiment is a self-contained plug, rather than a separate interconnector configuration. Contact prongs 15 and 16 are biased away from each other, but held in position by a nonconductive leaf spring 21, each end of which is riveted or otherwise secured to the respective lower portions of two separate contact prongs 15 and 16. A nonconductive, flexible plug cover 18 houses the prongs 15 and 16 and leaf spring 21.

Figure 5:
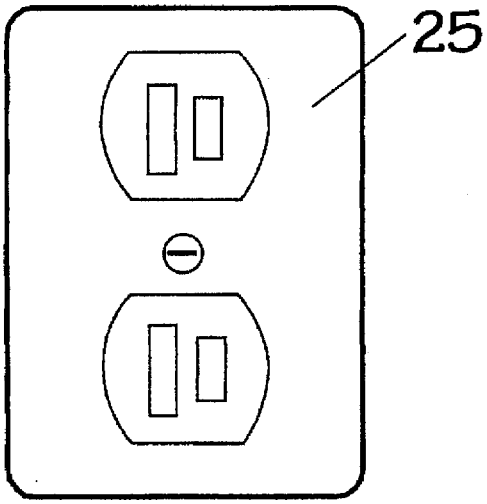
FIG. 5 is an isometric view of the device shown in FIG. 4.
Figure 5:
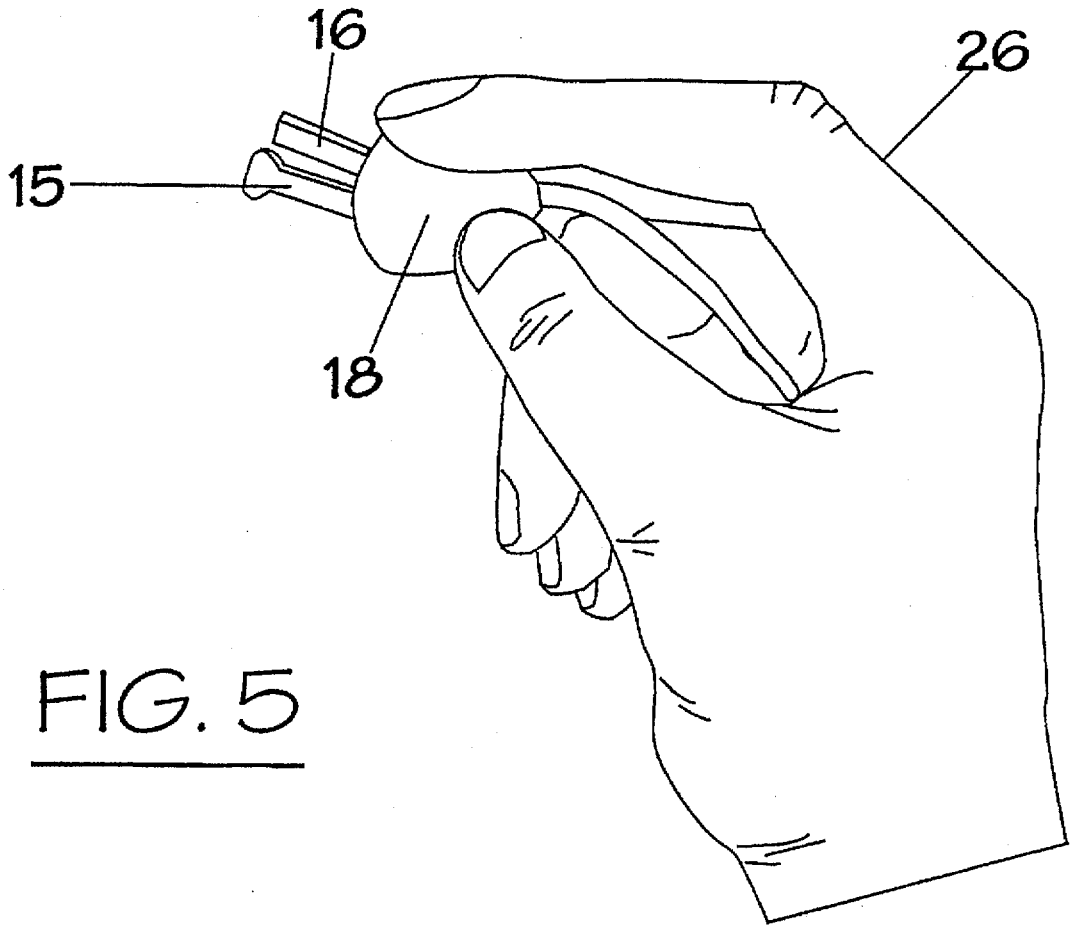

When squeezed (arrows C), shown also in FIG. 5, leaf spring 21 allows the upper portions of the two contact prongs 15 and 16 to move towards each other until they are substantially parallel and can be inserted into a worn electrical wall outlet, not shown. When pressure is removed from flexible plug cover 18, the contact prongs 15 and 16 move apart, forcing contact with the worn out, internal connectors of the wall outlet.

A nonconductive partition 17 electrically isolates the two contact prongs 15 and 16 from each other. An aperture 22 in the lowermost portion of the flexible plug cover 18 allows room for insertion of a two- or three-conductor electric cord (not shown). Two metal screws 19, internal to the plug assembly, allow the several wire ends of the electric cord to be secured to their respective contact prongs 15 and 16. Rivets 20 are used to securely attach prongs 15 and 16 to their respective ends of the nonconductive leaf spring 21.

FIG. 5 is an isometric view of the plug shown in FIG. 4 being squeezed by hand 26 in preparation for its insertion into a wall outlet 25. It should be understood that, although not depicted in the drawing, grounded, three-prong plugs and outlets, as well as polarized plugs, are expressly considered to be within the scope of the present invention.

Figure 6:
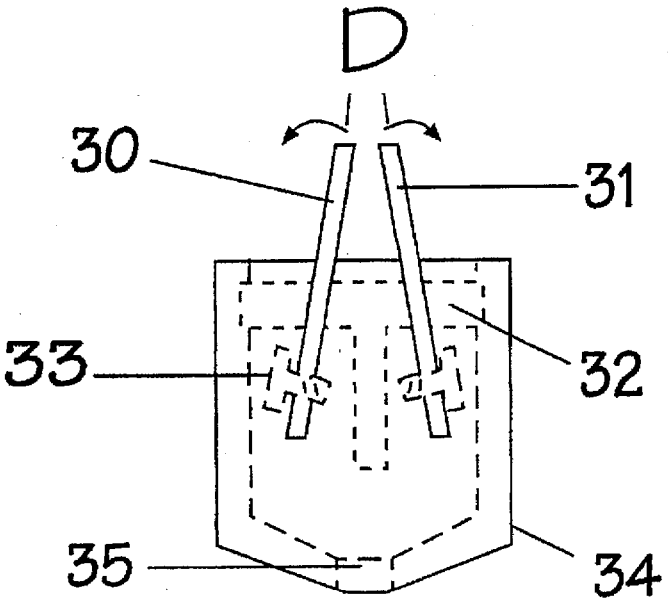
FIG. 6 is a cross-sectional side view of the device with prongs biased towards each other.

Referring now to FIG. 6, another embodiment of the inventive plug of FIG. 4 is shown. Contact prongs 30 and 31 are arranged and designed so as to be biased towards one another. Flexible housing 34 is squeezed, briefly, during operation to contort flexible cover 32 into which contact prongs 30 and 31 are securely molded. This in turn causes the upper portions of contact prongs 30 and 31 to move apart from each other (arrows D) and assume a substantially parallel orientation with respect to each other until they are inserted into a wall outlet and squeezing pressure is released. Once pressure is released, the cover 32 forces prongs 30 and 31 to move back towards each other, thus contacting the worn out connector parts inside the outlet into which they are inserted. An aperture 35 is provided in the flexible housing 34 so as to allow a standard electric cord to enter the housing 34 and be attached to appropriate metal screws 33.

Figure 7:
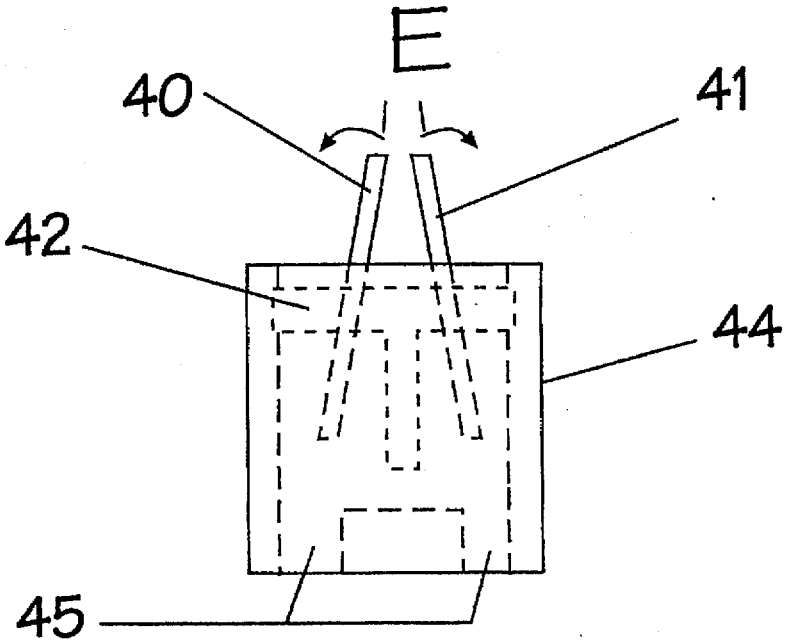
FIG. 7 is a cross-sectional side view of the device functioning as an interconnector, the prongs of which are biased towards each other.

Referring now also to FIG. 7, there is shown another embodiment of the invention designed to utilize the same principle as that described hereinabove with respect to FIG. 6. A separate interconnector or adapter is shown, into which a conventional plug (not shown) may be inserted. Contact prongs 40 and 41 pivot outwardly (arrows E) when flexible housing 44 is squeezed manually. Flexible cover 42 acts as a spring, holding prongs 40 and 41 in a position biased towards each other. When the interconnector or adapter is inserted into a wall outlet (not shown) or any other electrical outlet, it provides positive electrical contact by the action of cover spring 42 holding contact prongs 40 and 41 forcibly against the connectors inside the worn out electrical outlet. Openings 45 in the lower portion of the flexible housing 44 allow a conventional two- or three-pronged plug to be inserted into the electrical interconnector.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An adapter for securing the contact prongs of a conventional electric plug to a worn outlet, comprising:

a) a housing having at least two opposing, nonconducting side portions, each side portion having a top and a bottom;

b) a set of two contact prongs spaced apart from each other, said contact prongs being movably mounted to at least one of said housing side portions and extending out of the top of said housing; and c) said housing having at least one aperture disposed at the bottom thereof, through which electric plug prongs of a conventional plug can be inserted to force said contact prongs into electrical connection therewith.

2. The adapter in accordance with claim 1, wherein said contact prongs are pivotally mounted to at least one of said side portions.

3. The adapter in accordance with claim 1, further comprising a nonconductive spring proximate said contact prongs.

4. The adapter in accordance with claim 2, wherein said housing is flexible.

5. The adapter in accordance with claim 2, further comprising means operatively connected to at least one of said contact prongs for biasing said contact prongs towards one another.

6. An electrical plug having movable contact prongs for ensuring an electrical connection to a worn outlet, comprising:

a) a housing having at least two opposing, nonconducting side portions and an upper boundary;

b) a set of two independently movable contact prongs spaced apart from each other, each of said contact prongs having an upper end and a lower end, said upper ends of said contact prongs extending out of said upper boundary of said housing; and c) a single leaf spring disposed in said housing, said leaf spring being operatively connected, respectively, to each of said contact prongs for biasing said upper ends of said contact prongs away from each other.

7. The plug in accordance with claim 6, wherein said contact prongs are pivotally mounted to said housing.

8. The electrical plug in accordance with claim 6, wherein said housing is flexible.

9. The electrical plug in accordance with claim 6, wherein said housing further comprises a lower boundary, in which is formed an aperture for allowing an electrical cord to be inserted and connected to each of said contact prongs.

10. An adapter for securing the contact prongs of a conventional electric plug to a worn outlet, comprising:

a) a housing having at least two opposing, nonconducting side portions, each side portion having a top and a bottom; and b) a set of two contact prongs spaced apart from each other, said contact prongs having contoured, cam-surfaced lower ends, and being movably mounted to at least one of said housing side portions and extending out of the top of said housing, said housing having at least one aperture disposed at the bottom thereof, through which electric plug prongs of a conventional plug can be inserted to force said contact prongs into electrical connection therewith.

11. The adapter in accordance with claim 10, wherein said contact prongs are pivotally mounted to at least one of said side portions.

12. The adapter in accordance with claim 10, wherein said housing is flexible.

* * * * *